US010611171B2

(12) United States Patent
Cholewik et al.

(10) Patent No.: US 10,611,171 B2
(45) Date of Patent: Apr. 7, 2020

(54) DEVICE AND METHOD FOR INK SUPPLY IN DIGITAL PRINTING

(71) Applicant: Dekron GmbH, Kelkheim (DE)

(72) Inventors: Frank Cholewik, Hattersheim (DE); Thomas Schnitger, Eisenach (DE)

(73) Assignee: DEKRON GMBH, Kelkheim (DE)

( * ) Notice: Subject to any disclaimer, the term of this patent is extended or adjusted under 35 U.S.C. 154(b) by 0 days.

(21) Appl. No.: 16/089,378

(22) PCT Filed: Mar. 22, 2017

(86) PCT No.: PCT/EP2017/056768
§ 371 (c)(1),
(2) Date: Sep. 28, 2018

(87) PCT Pub. No.: WO2017/167611
PCT Pub. Date: Oct. 5, 2017

(65) Prior Publication Data

US 2019/0105918 A1 Apr. 11, 2019

(30) Foreign Application Priority Data

Apr. 1, 2016 (DE) ..... 10 2016 106 011

(51) Int. Cl.
*B41J 2/19* (2006.01)
*B41J 2/175* (2006.01)
(Continued)

(52) U.S. Cl.
CPC ..... *B41J 2/19* (2013.01); *B41J 2/175* (2013.01); *B41J 2/18* (2013.01); *B41J 2/195* (2013.01)

(58) Field of Classification Search
CPC . B41J 2/175; B41J 2/17596; B41J 2/18; B41J 2202/12; B41J 2/19; B41J 2/195
See application file for complete search history.

(56) References Cited

U.S. PATENT DOCUMENTS 4,638,337 A 1/1987 Torpey et al.
5,124,716 A 6/1992 Roy et al.
(Continued)

FOREIGN PATENT DOCUMENTS

EP 0352978 A2 1/1990
EP 1831025 B1 5/2008
(Continued)

OTHER PUBLICATIONS

Translation of Written Opinion with 371 submitted with filing—WO dated May 30, 2017; Translation Retrieved Aug. 2019. (Year: 2019).*

*Primary Examiner* — John Zimmermann
(74) *Attorney, Agent, or Firm* — Leydig, Voit & Mayer, Ltd.

(57) ABSTRACT

A device for ink supply during digital printing includes at least one print head having an inlet and an outlet. A feed tank for an ink medium is connected to the inlet of the at least one print head via a feed line. A return tank for the ink medium is connected to the outlet of the at least one print head via a return line. A gas volume is formed in the feed tank and/or in the return tank. The ink medium is conveyable through the at least one print head by a pressure of the gas volume in the feed tank and/or in the return tank.

19 Claims, 2 Drawing Sheets

(51) Int. Cl.
*B41J 2/18* (2006.01)
*B41J 2/195* (2006.01)

(56) References Cited

U.S. PATENT DOCUMENTS

| | | | | |
|---|---|---|---|---|
| 5,555,005 | A | 9/1996 | Pagnon | |
| 5,818,485 | A | 10/1998 | Rezanka | |
| 6,350,021 | B1 * | 2/2002 | Gray | B41J 2/175 347/78 |
| 8,418,608 | B2 | 4/2013 | Preckel | |
| 8,449,087 | B2 * | 5/2013 | Kataoka | B41J 2/175 347/84 |
| 2007/0252860 | A1 | 11/2007 | Nitta et al. | |
| 2008/0238980 | A1 * | 10/2008 | Nagashima | B41J 2/14233 347/17 |
| 2009/0174735 | A1 * | 7/2009 | Yamada | B41J 2/175 347/7 |
| 2009/0195588 | A1 * | 8/2009 | Ogama | B41J 2/04508 347/17 |
| 2010/0085396 | A1 | 4/2010 | Yokota et al. | |
| 2012/0062639 | A1 | 3/2012 | Nitta | |

FOREIGN PATENT DOCUMENTS

| | | | |
|---|---|---|---|
| EP | 2127883 | A1 | 12/2009 |
| EP | 2468512 | A1 | 6/2012 |
| WO | WO 2010130397 | A1 | 11/2010 |

* cited by examiner

DEVICE AND METHOD FOR INK SUPPLY IN DIGITAL PRINTING

CROSS-REFERENCE TO PRIOR APPLICATIONS

This application is a U.S. National Stage Application under 35 U.S.C. § 371 of International Application No. PCT/EP2017/056768 filed on Mar. 22, 2017, and claims benefit to German Patent Application No. DE 10 2016 106 011.9 filed on Apr. 1, 2016. The International Application was published in German on Oct. 5, 2017 as WO 2017/167611 A1 under PCT Article 21(2).

FIELD

The invention relates to a device and a method for ink supply to a print head in digital printing, comprising at least one print head, a feed tank for an ink medium, wherein the feed tank is connected to the inlet of the at least one print head via a feed line, and a return tank for the ink medium, wherein the return tank is connected to the outlet of the at least one print head via a return line.

BACKGROUND

Digital inkjet printing by means of drop-on-demand print heads is now a commonly used application in industry. A wide variety of inkjet printer variants for desktop and office printers has been known in the art for many years. However, the print heads used in industry are differently designed to those for desktop and office printers and typically also consume substantially more ink due to the large areas to be printed. The printing of bottles, for example, can generate an annual consumption of several tons. A suitable ink supply is therefore an essential component of printing systems of this kind and has a crucial influence on the quality of the print result and profitability.

Drop-on-demand print heads have a small ink chamber behind each nozzle, which is filled with the ink medium. The ink medium is ejected through the nozzles of the print head by a short-term increase in pressure being generated in said ink chamber using various methods. In the method known from EP 0 352 978 A2, a minimum part of the ink medium is heated by heating in the ink chamber, so that part of the ink medium is evaporated. The resulting expansion generates a pressure pulse.

In the method described in U.S. Pat. No. 5,124,716 A a pressure pulse is generated in the ink chamber of the print head via a piezoelectric crystal. This pressure pulse causes a drop of the ink medium to be pressed through the nozzle and therefore ejected.

The print heads, which usually have about a thousand nozzles, require there to be a negative pressure inside the ink chamber upstream of the nozzles, since otherwise the low-viscosity inks would leak out of the nozzles, despite the nozzle openings being small, only micrometres in size. This negative pressure is in the order of roughly −10 mbar.

Two different types of print heads are generally used in industry. One works as a dead-end shooter in which the ink medium is simply applied to the print head and the supply is achieved via the geodetic height (cf. U.S. Pat. No. 4,638,337 A). This means that the ink medium is conveyed to the print head and said print head with its ink chambers for the ink medium forms a dead end until the ink is ejected through the nozzles. The pressure inside the ink chambers of the print head substantially corresponds to the pressure at the inlet of the print head in this case. The negative pressure in the print head may cause air to be drawn into the print head through the nozzles. The air bubbles in the ink chamber resulting from this mean that the volume in the ink chamber is compressible, as a result of which a pressure build-up for emitting a drop is not possible in a reproducible manner.

The second possibility is the so-called recirculation method, as is known from U.S. Pat. No. 5,818,485 A, for example. In this case, the ink is repeatedly pumped through the print head so that there is a continuous flow of ink through the print head. In this way, the air drawn through the nozzles can, where necessary, be removed from the ink chamber once again.

These print heads were originally designed for planographic printing, in which the surface is to be printed lies in a horizontal plane and the ink is applied from top to bottom, as is the case with typical office printers were. Meanwhile, the print heads are also used in a vertical arrangement, however. This has the advantage that when printing three-dimensional objects the side surfaces can also be printed, without the side to be printed being moved into a horizontal position. When printing bottles, for example, they would otherwise have to be turned over for a very short time (about 1/10 second) and then realigned.

However, the vertical arrangement requires a completely different precision in the ink supply. The print heads themselves typically have a printing length via the nozzles, in other words a distance between the lowermost and uppermost nozzle, of about 70 mm. Therefore, the pressure difference due to gravity within the nozzles of a vertically disposed head, assuming a density of 1000 kg/m$^3$, is only 7 mbar. The lowermost nozzle therefore has an ink supply pressure that is 7 mbar higher than the uppermost nozzle. At a nominal pressure of −10 mbar there is no longer any scope for tolerance. Any pressure fluctuation can therefore be decisive as to whether the quality is sufficient for good printing.

Known recirculation systems have a first tank from which the ink is supplied to the head at positive pressure by means of a pump, and a return pump which generates a negative pressure at the ink outlet of the print head which is high enough to generate the negative pressure described in the print head due to the flow resistance in the print head.

In this case, pumps denote machines for conveying substantially incompressible fluids, such as an ink medium, for example. Pumps are to be distinguished from compactors and compressors which are machines for compressing and conveying gases and gaseous media.

The pressure prevailing within the print head upstream of the nozzles is referred to as the meniscus pressure which corresponds to the nominal pressure in the print head and which, as described, should be a slight negative pressure. Also important for the function of the print head is the pressure difference between the feed and return which is responsible for the flow rate, in other words the throughput of ink through the print head.

In order to maintain a uniform pressure, the ink supplies known in the art work with pumps for the ink and pulsation dampers. These systems have a highly complex design and elaborate control. In this case, despite the smoothing by the pulsation dampers, pressure spikes can occur which severely affect the print quality.

SUMMARY

In an embodiment, the present invention provides a device for ink supply during digital printing, including at least one print head having an inlet and an outlet. A feed tank for an ink medium is connected to the inlet of the at least one print head via a feed line. A return tank for the ink medium is connected to the outlet of the at least one print head via a return line. A gas volume is formed in the feed tank and/or in the return tank. The ink medium is conveyable through the at least one print head by a pressure of the gas volume in the feed tank and/or in the return tank.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
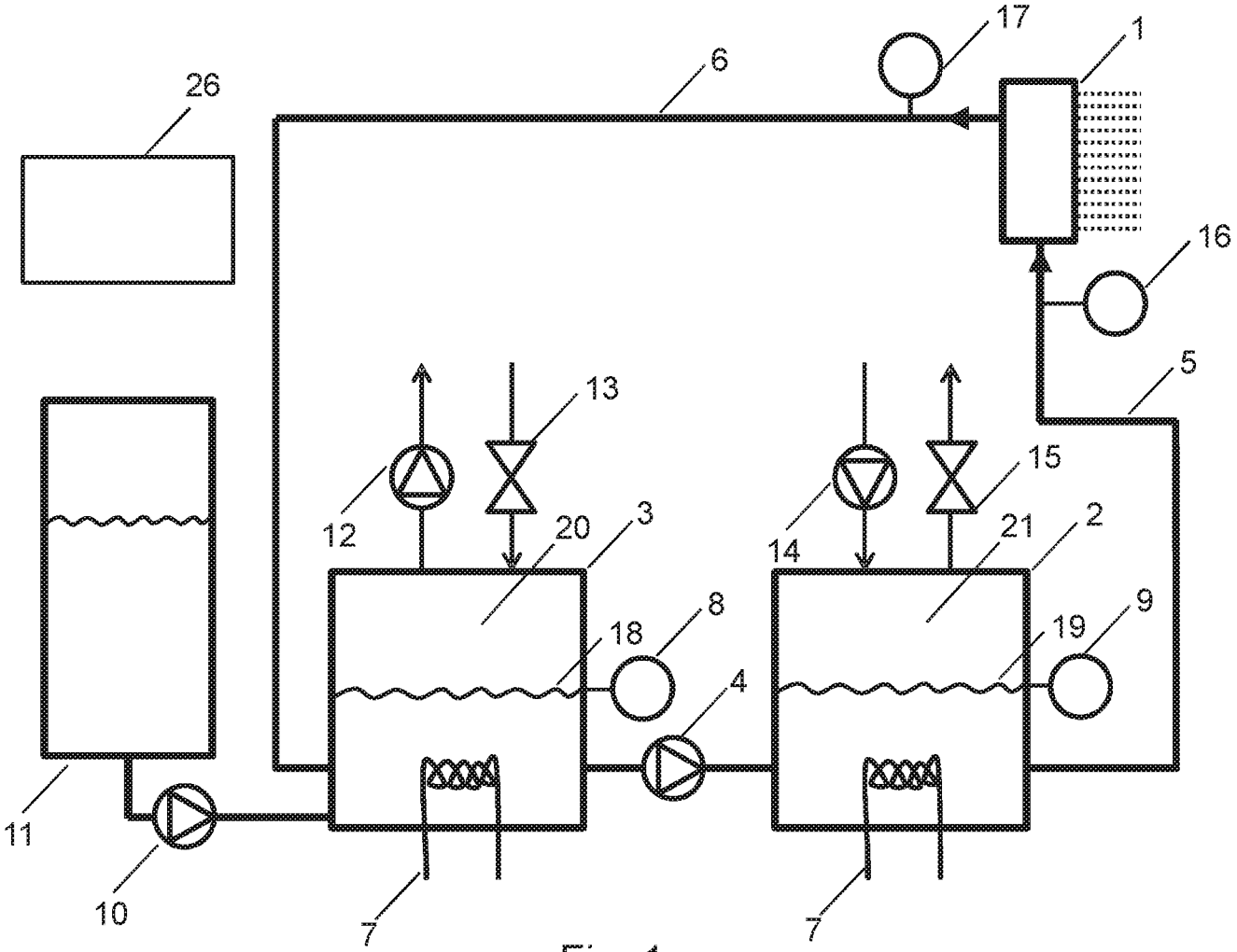
FIG. 1 shows schematically a device according to an embodiment of the invention for ink supply.

Embodiments of the present invention ensure uniform pressure at the, and in the, print head during the supply of ink for print heads in digital printing.

The device according to an embodiment of the invention for the ink supply in digital printing has at least one print head in this case, which is to be supplied with an ink medium. This print head may be a drop-on-demand print head which has an inlet and an outlet for the ink supply, so that it can have a continuous through-flow of the ink medium. The device also includes a feed tank which is connected via a feed line to the inlet of the print head, in order to supply the ink medium to said print head. Furthermore, the ink supply has a separate return tank which is connected via a return line to the outlet of the print head, in order to remove the unused, in other words non-ejected, ink medium. The feed and return in this case may be configured as a pipeline, hose or the like. All line connections can be fitted with self-locking plug-in couplings. The ink medium may be any ink or other fluid that is applied instead of the ink by the print head. Functional materials are also conceivable in this case which, for example, produce an electrically conductive structure or have other preferred properties.

A gas volume is formed in the feed tank and/or in the return tank. For this purpose, in the simplest case the tanks cannot be completely filled with the ink medium, so that a volume filled with gas is arranged above the ink medium, in other words above the ink fluid level. This volume may, for example, be filled with air, nitrogen or another inert gas, for example. An inert gas in this case can prevent hardening, changing and/or contamination of the ink medium. The gas in the volumes in the feed tank and return tank is under pressure in each case. This may be an excess pressure or a negative pressure relative to the external pressure. Another possibility is that the feed and/or return tank may have a separate tank for the gas volume which may be regarded according to the invention as a constituent of the feed tank or the return tank. It is likewise possible for the feed tank and the return tank to be configured as separate chambers of a large joint tank.

The gas pressures in the feed tank and return tank produce a pressure difference between the inlet and outlet of the print head for conveying the ink medium. This creates a flow of ink from the feed tank through the print head into the return tank. The ink flow is therefore not driven by fluid pumps in direct contact with the ink medium, but brought about by the gas pressures. The compressibility of the gas means that no severe pressure fluctuations occur in the ink medium. Pressure surges are filtered out naturally by the volume of gas acting as a buffer.

In a preferred embodiment, the device has a pressure control device in the feed tank and/or the return tank. This may be configured as a pressure build-up and/or pressure relief device. For example, a pressure build-up and a pressure relief device can be provided in each of the two tanks, with which the pressure can be generated and kept constant. In this case, the pressure build-up device of the feed tank may be suitable for generating an excess pressure in the feed tank, as with a compressor for example. A further possibility is the controlled connection to a compressed air connection or a suitable reservoir. A compressor working in the reverse direction or a vacuum pump which draws gas from the return tank, for example, may be provided in the return tank for producing a negative pressure. Rotary vane pumps, diaphragm pumps and scroll pumps, among others, are particularly suitable. The latter two are oil-free pumps, as a result of which contamination of the ink medium can be avoided particularly efficiently. A regulated connection to an existing negative pressure suction line or a negative pressure reservoir is also possible. The pressure relief devices may be other active or passive devices such as ventilation valves and/or bleeder valves.

In a preferred embodiment, the device comprises a control system which is set up to regulate the pressures in the gas volumes in the feed tank and/or return tank, so that the pressure difference between the inlet and outlet of the print head and/or the meniscus pressure of the print head correspond to a predetermined reference value. The meniscus pressure refers to the pressure within the print head upstream of the outlet nozzles of the print head. The gas pressures may be regulated by controlling the pressure build-up and pressure relief devices of the feed tank and return tank. The reference values in this case can be set in the control system or they may depend on other operating parameters or manual entries. The control system in this case allows the pressures to be kept at the reference values, even if gases dissolved in the ink medium can degas and thereby alter the pressure or if the ink medium has absorbed air bubbles that have thereby entered the circulation.

In a further preferred embodiment, a pump is arranged as the circulating pump between the feed tank and the return tank, which circulating pump can pump ink medium from the return tank to the feed tank. The ink circulation can be closed by a pump of this kind, so that the ink medium that has been discharged can be replaced in the feed tank by ink medium from the return tank. The circulating pump can be regulated using a separate or a joint control system which is also responsible for regulating the gas pressures. The pressure range of the circulating pump is non-critical in this case, for example it can only be dependent on the filling level of the feed tank.

In a further preferred embodiment the device moreover has a level sensor in the feed tank and/or return tank. The measured values of the sensors in this case can be detected by a control system and used to regulate the actuators, such as pumps, compressors and valves.

In a further preferred embodiment, the return tank has a refilling pump. This may be connected to an ink reservoir from which the pump can refill the return tank with ink medium. This enables the consumed ink medium, in other words the ink medium ejected from the print head, to be replaced.

In a further preferred embodiment, a shut-off valve is arranged in the feed line and/or in the return line. These shut-off valves are open during normal operation to allow a flow of ink to and from the print head.

By shutting off the connection to the return tank, the meniscus pressure rises to the value of the pressure at the inlet of the print head. This excess pressure in the print head causes ink to be ejected through all nozzle openings of the print head. This means that nozzle openings that may have been clogged up can be rinsed through, making removal or replacement of the print head unnecessary.

By shutting off the connection to the feed tank, the meniscus pressure drops to the value of the pressure at the outlet of the print head. The negative pressure in the print head causes air to be drawn in through all nozzle openings of the print head. In this way, any possible contaminants in the print head which are too large to be flushed out through the nozzle holes can be removed from the print head.

In a further preferred embodiment, a bypass line is arranged about the print head as a bypass. In this way, the ink can flow past the feed tank into the return tank. At least one shut-off valve is provided in this bypass line, in order to prevent the flow through the bypass line. This shut-off valve is closed during normal operation. The bypass line may be attached in such a manner that the connection to the feed in the flow direction is located upstream of a possible shut-off valve in the feed. In the return, the connection in the flow direction may lie downstream of a possible shut-off valve in the return. In this way, when shut-off valves are closed in the feed and return and when the shut-off valve is opened in the bypass, the ink can flow unhindered through the bypass.

If a print head is to be changed, for example, as a first step the shut-off valve in the feed can be closed, as a result of which the print head is drained by the return. The shut-off valve in the return can then also be closed and the shut-off valve in the bypass line opened. In this way, the print head can be dismantled and replaced with a new print head where necessary, without interrupting the flow of ink for a prolonged period.

In a further preferred embodiment, a heating device is provided in or on the feed tank and/or return tank. In this way, the ink medium can easily be kept at the appropriate temperature for printing. Through direct heating of the tanks with their large surfaces, a heat exchanger arranged in the ink circuit can be dispensed with and yet the system in the circuit, including all lines, can still be heated.

In a further preferred embodiment, all parts can be housed in a single housing. This makes it easier to replace the ink supply device in particular.

In another embodiment, the present invention provides a method for supplying ink. In this case, an ink medium is conveyed from a feed tank to a print head and from the print head to a return tank. The conveyance of the ink in this case is carried out by a pressure in a gas flow volume of the feed tank and/or a pressure in a gas volume of the return tank. The ink medium can, for example, flow through a floor drain or a drain fitted close to the floor from the feed tank through the print head to the return tank.

The ink medium can then be pumped from the return tank back into the feed tank in order to close the ink circulation. The fact that the movement of the ink medium does not take place through direct driving of the ink medium by means of a pump, but through the gas pressures, means that pressure spikes can be successfully avoided. The recirculation volumes of approximately 150 ml/h per print head are very small and very uniform. There is therefore only a very small fluctuation of the filling level in the feed tank.

The pressure in the gas volume of the feed tank and/or the return tank is particularly preferably set in such a manner that the delivery rate, in other words the flow through the print head, results due to the differential pressure and a meniscus pressure is maintained in the print head. The setting of the pressures can be taken over by a control system which can to revert to measurements taken by one or multiple sensors for this purpose. In this case, for example, the gas pressures can be measured in the feed tank and return tank or the pressures of the ink medium directly at the inlet and outlet of the print head. The meniscus pressure can be determined from these values or likewise measured directly in the print head. The meniscus pressure should typically be maintained at a slightly negative pressure of about −10 mbar.

The level in the feed tank, in other words the height of the ink liquid level in the feed tank, is preferably kept roughly constant during the ink supply. Measurements taken by a sensor can be compared with reference values for this purpose and, where necessary, ink medium can be reconveyed by the circulating pump from the return tank. The constant ink liquid level means that the gas pressure in the feed tank need only rarely be reset.

The level in the return tank, in other words the height of the ink liquid level, is also preferably kept within a predefined range. Since the exact level in the return tank is non-critical, a top-up can only be instigated, where necessary, when the level has dropped below a minimum filling level. For this purpose, measurements taken by a sensor can be compared with reference values and, where necessary, ink medium in the return tank can be replaced by topping up. This is necessary as the amount of ink returned to the return tank is smaller by the amount of ink medium consumed than the ink medium removed from the return tank into the feed tank. The control system can detect all consumption values and report them to a higher control system.

When topping up the ink, the gas pressure would rise in the return tank and therefore affect the printing process. Gas in the gas volume of the return tank is therefore pumped off simultaneously to keep the pressure roughly constant. However, since the ink consumption of a print head is very low at a few ml/h, the top-up quantity also requires only a slight re-adjustment of the gas pressure.

The two tanks can therefore be kept small, so that the response time of the control is kept short. A volume of between 50 and 350 ml per tank is preferred.

The different control processes in the system are properly uncoupled from one another and therefore can easily be controlled.

At least one of the gas pressures can preferably be controlled depending on the installation height of the print head. In this case, the difference in height between the ink liquid level in the feed tank and the print head can have an impact on the actual pressure at the inlet of the print head. The higher the print head is positioned above the feed tank, the greater the selected gas pressure in the feed tank must be, in order to achieve the necessary pressure at the inlet of the print head. Similarly, the height difference between the return tank and the print head may have an impact on the actual pressure at the outlet of the print head. The higher the print head is positioned above the return tank, the greater the selected gas pressure in the return tank must be, in order to achieve the necessary pressure at the outlet of the print head. The absolute height above sea level must also be taken into consideration, since even at 100 m above sea level an outside pressure that is 12 mbar lower than at sea level prevails. The meniscus pressure must therefore be adjusted in such a manner that a low negative pressure of −10 mbar is produced in relation to the outside pressure, in order to prevent the ink medium from escaping through the nozzles.

At least one of the gas pressures is preferably dynamically adapted to different operating conditions or operating parameters. Possible operating parameters in the case of rotary digital printers include, for example, the position of the print head on the printer and/or the alignment of the print head in relation to the rotational axis and/or the gravitational direction. The dynamic adjustment of the gas pressures to these operating parameters allows new dynamic machine systems. Previous systems have been static, non-portable or moving with a uniform movement and therefore with uniform forces on the ink medium in the system. There are, however, new digital printer designs that work dynamically in which, for example, the print heads rotate in a carousel. The ink medium in the print heads in rotary systems of this kind is subject to centrifugal force, depending on the distance from the rotational axis and the speed. Until now, printers of this kind have been operated at a constant speed because their ink supply has not allowed regulation of the ink pressure. The inventive adjustment of the gas pressures to the speed or other operating conditions means that these can now be dynamically varied. This can be carried out particularly easily because the gas volumes mean that the system causes a certain amount of inertia. The buffer of compressible gas in the gas volumes means that there can be no great fluctuations in the pressure control. This prevents the negative pressure from becoming too great and the print heads thereby drawing in air or the excess pressure becoming too great and ink leaking out of the print head. The control speed is therefore easily adapted to a speed control of carousel machines. This allows the printer to be integrated in a bottling plant, for example, and said bottling plant to be operated according to the number of bottles available in such a manner that stop-and-go operation is avoided.

The invention is explained in greater detail below by means of exemplary embodiments and with reference to the figures. All the features described and/or illustrated individually or in any combination in this case form the subject matter of the invention, also independently of their combination in the claims or the appendancies thereof.

FIG. 1 shows a device according to the invention for ink supply in digital printing. This consists of a preferably vertically disposed print head 1 which is connected at its inlet via a feed line 5 to a feed tank 2 and at its outlet via a return line 6 to a return tank. 3 A recirculating pump 4 is arranged between the return tank 3 and the feed tank 2, which recirculating pump can convey ink from the return tank 3 to the feed tank 2. The return tank 3 is connected to a refilling pump 10 which can pump ink from an ink reservoir 11 into the return tank 3. Both in the feed tank 2 and the return tank 3 is arranged a heating element 7 for heating the ink medium.

The feed tank 2 and return tank 3 are not completely filled with ink, but still have a volume 20, 21 filled with gas over the ink liquid level 18, 19. This gas can be drawn through a suction device 12 in the return tank 3, as a result of which a negative pressure is generated in the gas volume 20 of the return tank 3. A diaphragm pump may be provided as the suction device. In order to reduce the negative pressure, in other words to bring the pressure closer to the outside pressure, the return tank 3 has a ventilation valve 13. The feed tank 2 has a compressor 14 with which gas can be conveyed into the gas volume 21 of the feed tank 2, as a result of which an excess pressure is generated therein. In order to reduce the excess pressure, the feed tank 2 has a bleeder valve 15. The gas pressures 20, 21, along with other physical influences such as the height of the ink liquid level, the installation height of the print head and the flow resistance, produce an excess pressure at the inlet of the print head 1 and a negative pressure at the outlet of the pressure head 1. The pressures can be measured right at the inlet or outlet of the print head 1 by an excess pressure sensor 16 in the feed and a negative pressure sensor 17 in the return. In order to determine the filling level of the feed tank 2 and return tank 3, these each have a filling level sensor 8, 9.

A control system 22 measures the pressures of the excess pressure sensor 16 and the negative pressure sensor 17 and compares these with reference values. The reference values for the absolute pressures at the inlet and outlet of the print head 1 may result from reference values for the pressure differential and the meniscus pressure. If the inlet pressure is too low, the gas pressure in the feed must be increased. For this purpose, the compressor 14 is activated by the control system 22 and the gas is thereby conveyed into the feed tank 2. If, on the other hand, the pressure at the inlet of the print head 1 is too high, the bleeder valve 15 is opened by the control system 22, so that gas is discharged from the feed tank 2. Similarly, the pressure at the outlet of the print head 1 is regulated by the pressure regulating devices 12, 13 in the return tank 3. If there is an excessive pressure at the outlet of the print head 1, so at the negative pressure sensor 17, the pressure in the return tank 3 must be reduced. For this purpose, the suction device is switched on by the control system 22 and gas is thereby pumped out of the return tank 3. If, on the other hand, the pressure is too low, the control system 22 can open the venting valve 13 and thereby let gas into the return tank 3. Rather than switching the compressor and the discharge device on and off, this can be operated, as required, with an adjusted output. The control system 22 then regulates the output up and down, as required.

If the pressures are correctly set up by the control system 22, the ink is transported by the excess pressure in the feed tank 2 through the feed line 5 to the inlet of the print head 1. Moreover, the control system 22 measures the ink liquid level 19 in the feed tank by means of the filling level sensor 9 and keeps it at a virtually constant level by regulating the recirculating pump 4 between the return tank 3 and the feed tank 2.

Due to the pressure difference between the inlet and outlet of the print head 1, the ink medium is conveyed through the print head. 1 That part of the ink that has not been ejected through the print head 1 is transported back through the return line 6 to the return tank 3. Since the ink consumption means that less ink is returned to the return tank 3 than is conveyed by the recirculating pump 4 into the feed tank 2, the ink liquid level 18 in the return tank 3 drops, as a result of which the pressure of the gas volume 20 is also reduced. This is therefore readjusted by the ventilation valve 13 and the compressor 12. The control system 22 also determines the height of the ink liquid level 18 by means of the level sensor 8 and regulates the refilling pump 10 where necessary, in order to refill ink from the ink reservoir 11 in the return tank 3, so as to prevent the return tank 3 from running dry.

Figure 2:
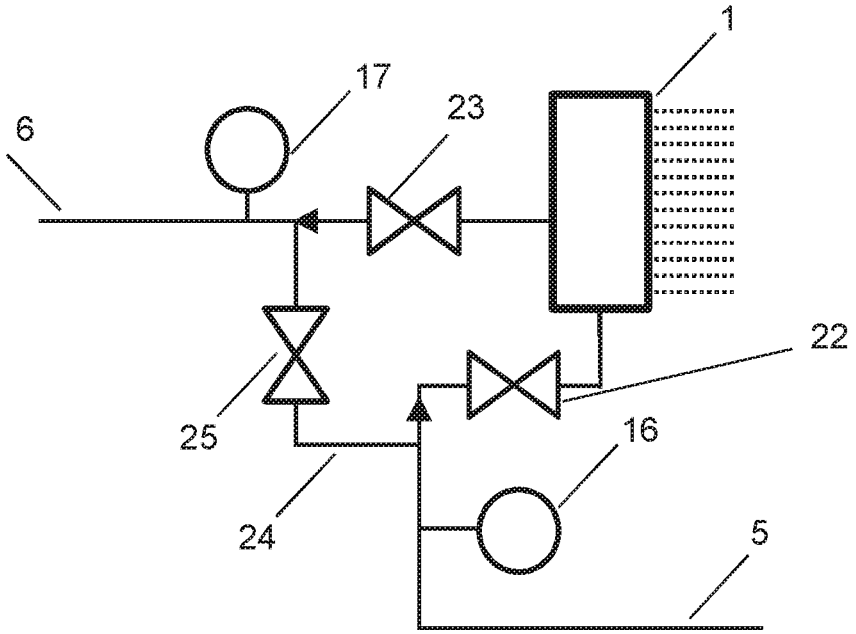
FIG. 2 shows schematically a detail of an ink supply according to an embodiment of the invention.

FIG. 2 shows a detail of an embodiment of a device according to the invention for ink supply in which a multi-way valve system is installed around the print head 1. This consists of a shut-off valve 22 in the feed line 5, a shut-off valve 23 in the return line 6 and a bypass line 24 with a bypass valve 25.

During normal operation, the shut-off valves 22, 23 are opened and the bypass valve 25 is closed.

If the shut-off valve 23 is closed, the meniscus pressure rises in the print head 1, as a result of which there is an ink flow from all nozzle openings in the print head 1. This increased ink flow means that blockages in the nozzles are dislodged and impurities removed from the print head 1.

If the shut-off valve 22 is closed and the shut-off valve 23 remains open, the meniscus pressure in the print head 1 drops to the pressure at the outlet of the print head 1. This causes the print head 1 to run dry and air from the environment is drawn through the nozzles.

If the bypass valve 25 is opened, the ink flows past the print head 1 through the bypass line 24. When the shut-off valves 22, 23 are closed, the print head 1 can be removed in order to change the print head for example, without interrupting the flow of ink from the feed tank 2 to the return tank 3.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMBERS

1 Print head
2 Feed tank
3 Return tank
4 Recirculating pump
5 Feed line
6 Return line
7 Heating
8 Return tank level sensor
9 Feed tank level sensor
10 Refilling pump
11 Ink reservoir
12 Suction device
13 Ventilation valve
14 Compressor
15 Bleeder valve
16 Excess pressure sensor
17 Negative pressure sensor
18 Return tank ink liquid level
19 Feed tank ink liquid level
20 Return tank gas space
21 Feed tank gas space
22 Feed shut-off valve
23 Return shut-off valve
24 Bypass line
25 Bypass line shut-off valve
26 Control system

The invention claimed is:

1. A device for ink supply during digital printing, the device comprising:

at least one print head having an inlet and an outlet;

a feed tank for an ink medium having a volume of between 50 ml and 350 ml, the feed tank being connected to the inlet of the at least one print head via a feed line;

a return tank for the ink medium having a volume of between 50 ml and 350 ml, the return tank being connected to the outlet of the at least one print head via a return line;

an excess pressure sensor disposed in the feed line for measuring an excess pressure at the inlet of the at least one print head; and a negative pressure sensor disposed in the return line for measuring a negative pressure at the outlet of the at least one print head, wherein a gas volume is formed in the feed tank and/or in the return tank, and wherein the ink medium is conveyable through the at least one print head by a pressure of the gas volume in the feed tank and/or in the return tank.

2. The device for ink supply during digital printing according to claim 1, wherein the feed tank and/or the return tank has a pressure control device configured to regulate the gas pressure in the feed tank and/or return tank.

3. The device for ink supply during digital printing according to claim 1, further comprising a control system which is set up to regulate the pressure in the gas volume in the feed tank and/or return tank, so that the pressure difference between the inlet and outlet of the print head and/or the meniscus pressure of the print head correspond to a reference value.

4. The device for ink supply during digital printing according to claim 1, further comprising a pump arranged between the feed tank and the return tank.

5. The device for ink supply during digital printing according to claim 1, wherein the feed tank and/or the return tank have a level sensor.

6. The device for ink supply during digital printing according to claim 1, wherein the return tank is connected to a refilling pump.

7. The device for ink supply during digital printing according to claim 1, further comprising a shut-off valve arranged in the feed line and/or in the return line.

8. The device for ink supply during digital printing according to claim 1, further comprising a bypass line with a shut-off valve arranged about the print head.

9. The device for ink supply during digital printing according to claim 1, wherein the feed tank and/or the return tank have a heating device.

10. A method for ink supply during digital printing, the method comprising:

conveying an ink medium from a feed tank to an inlet of a print head via a feed line and at least partially from an outlet of the print head to a return tank via a return line, wherein the tanks each have a volume of between 50 ml and 350 ml, wherein the conveyance of the ink medium is realized by a pressure in a gas volume of the feed tank and/or a pressure in a gas volume of the return tank;

measuring, by an excess pressure sensor disposed in the feed line, an excess pressure at the inlet of the print head; and measuring, by a negative pressure sensor disposed in the return line, a negative pressure at the outlet of the print head.

11. The method for ink supply during digital printing according to claim 10, wherein the pressure in the gas volume of the feed tank and/or return tank is set in such a manner that a conveying output results from the pressure difference between the inlet and outlet of the print head and/or a meniscus pressure is maintained in the print head.

12. The method for ink supply during digital printing according to claim 10, wherein a level of the ink medium in the feed tank is detected and regulated by a sensor.

13. The method for ink supply during digital printing according to claim 10, wherein the ink medium that has been discharged is replaced by refilling the return tank.

14. The method for ink supply during digital printing according to claim 10, wherein the pressure in the gas volume of the feed tank and/or of the return tank is regulated depending on an installation height of the print head.

15. The method for ink supply during digital printing according to claim 10, wherein the pressure in the gas volume of the feed tank and/or of the return tank is regulated depending on an operating parameter.

16. The device for ink supply during digital printing according to claim 1, further comprising a controller configured to compare the measurements of the excess pressure and the negative pressure to reference values and to regulate the pressure of the gas volume in the feed tank and/or in the return tank based on the comparison.

17. The method for ink supply during digital printing according to claim 10, wherein the pressure in the gas volume of the feed tank and/or of the return tank is regulated based on the measurement of the excess pressure and/or the measurement of the negative pressure.

18. The method for ink supply during digital printing according to claim 17, wherein the pressure in the gas volume of the feed tank and/or of the return tank is regulated such that a pressure difference between the excess pressure and the negative pressure corresponds to a predetermined reference value.

19. The method for ink supply during digital printing according to claim 17, wherein the measurements of the excess pressure and the negative pressure are compared to reference values and, based thereon, the pressures in the gas volumes of the feed tank and the return tank are adjusted.

* * * * *